United States Patent [19]

King

[11] 4,068,808

[45] Jan. 17, 1978

[54] TWO PART PLASTIC REEL

[76] Inventor: Richard J. King, c/o Galley Industries, 149 Hamilton St., Leominster, Mass. 01453

[21] Appl. No.: 769,283

[22] Filed: Feb. 16, 1977

[51] Int. Cl.[2] ..... B65H 75/14

[52] U.S. Cl. ..... 242/118.4; 242/118.7

[58] Field of Search ..... 242/118.7, 118.6, 118.61, 242/118.62, 118.4, 118.8, 118, 71.8, 71.9, 73, 77

[56] References Cited

U.S. PATENT DOCUMENTS

| | | | |
|---|---|---|---|
| 1,560,120 | 11/1925 | Teed | 242/118.6 X |
| 2,527,519 | 10/1950 | Bliss | 242/118.61 |
| 3,334,841 | 8/1967 | Burhop | 242/118.61 |

*Primary Examiner*—George F. Mautz
*Attorney, Agent, or Firm*—Charles R. Fay

[57] ABSTRACT

A two part molded plastic reel wherein the parts are alike, and each part comprises a flange and a part of the spool, said spool parts being axially telescoped together to complete the reel. Each spool part has an exterior semi-flexible tooth member thereon which engages with a complementary inner fixed tooth member on the other part, so that the two spool parts when shoved together form a complete double wall spool which cannot be separated thereafter.

7 Claims, 6 Drawing Figures

FIG. 1
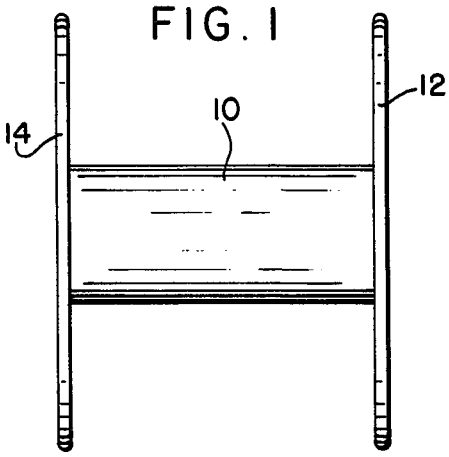
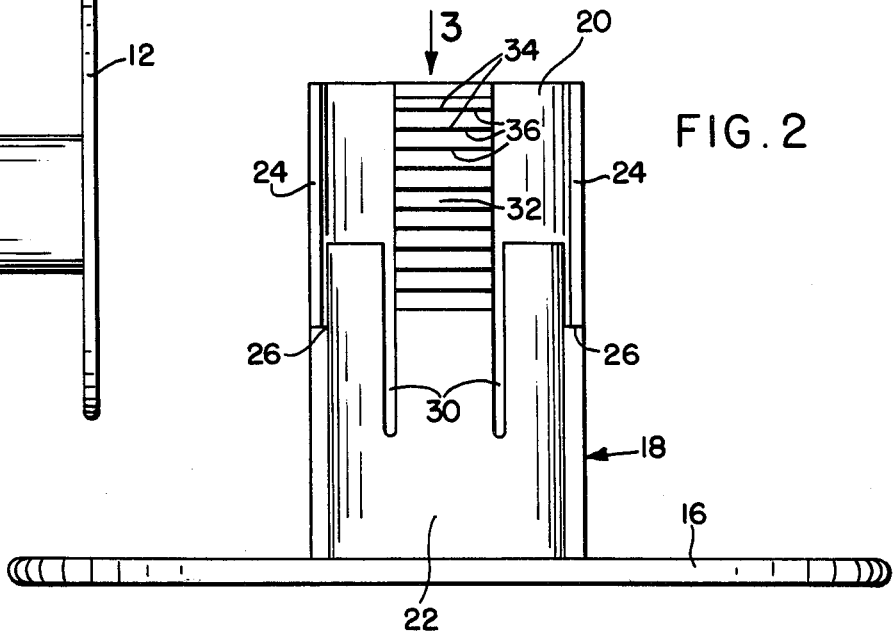
FIG. 2
FIG. 3
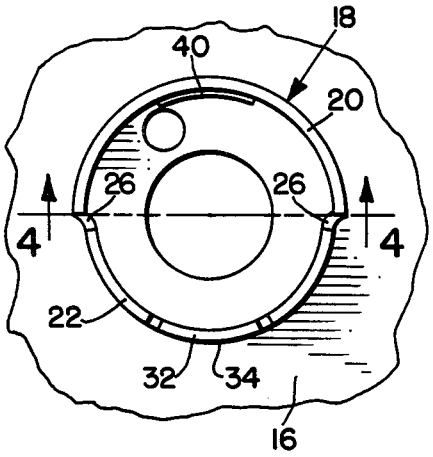
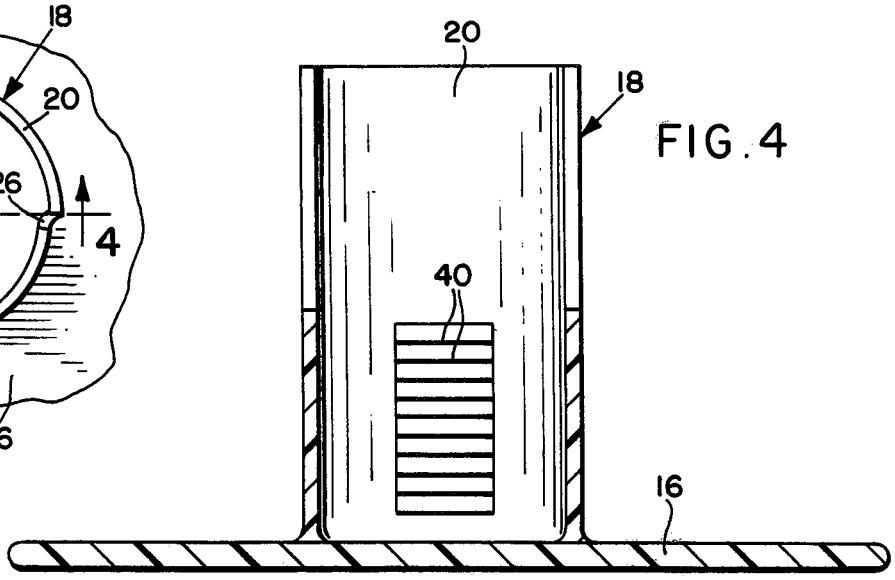
FIG. 4
FIG. 5
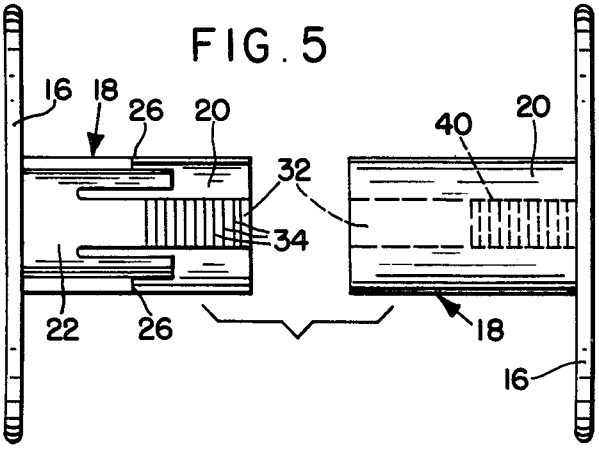
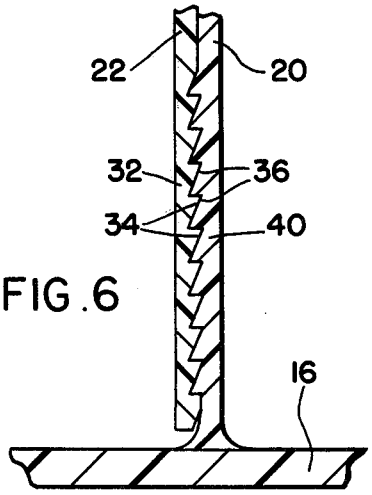
FIG. 6

TWO PART PLASTIC REEL

BACKGROUND OF THE INVENTION

Plastic spools of the prior art are commonly made by cementing two flanges at the end of a short spool, the spool having the form of a hollow cylinder formed by extruding. Not only is it relatively expensive to assemble these reels but they take up a good deal of room in shipment, which is wasteful, and at times the flanges bend while winding. It is the object of the present invention to provide an improved stronger, plastic reel comprising two separate complementary parts which are quickly and easily telescoped with snap over teeth or a serrated structure such that they cannot be separated once applied and snapped together.

SUMMARY OF THE INVENTION

The reel of the present invention comprises two parts which are identical, each part comprising a more or less usual flange and molded integrally therewith a spool member generally cylindrical part. These spool members are adapted to be telescoped together to form a single hollow cylindrical double-wall stronger spool permanently attached with respect to the flanges.

These reel parts are conveniently and inexpensively shipped and are quickly and easily snapped together to form a permanent reel which is less expensive than prior art reels both to manufacture, assemble, transport and store, and in which the spool is so strong as to prevent bending of the reel.

Each spool part comprises two semi-cylindrical members of slightly different radius. The smaller of the two has a longitudinal free-ended tongue that is semi-flexible and has a series of exterior teeth which are undercut in such a way as to present an angular portion at one side of each tooth and a right angular portion at the other side thereof so that corresponding teeth when snapped thereover will be permanently secured thereto.

The other and larger half of each of the spool parts comprising the member of greater radius is substantially continuous and solid and the smaller of the mating parts will fit within it. The part of greater radius has fixed interior teeth complementary to the teeth on the tongue.

In snapping the toothed spool parts together, the parts of greater radius are arranged at diametrically opposite positions which bring the flexible teeth into engagement with the fixed teeth, and a quick snapping or pushing motion causes these spool parts to be snapped together and incapable of being retracted one from the other thereafter. The spool is double-walled and much stronger than prior art spools of simple cylindrical form.

BRIEF DESCRIPTION OF THE FIGURES

FIG. 1 is a view of an assembled reel;

FIG. 2 is a view in elevation of one reel part;

FIG. 3 is a plan view thereof looking in the direction of arrow 3 in FIG. 2;

FIG. 4 is a section on line 4—4 of FIG. 3;

FIG. 5 illustrates two like reel parts to be connected together; and

FIG. 6 is an enlarged section showing a set of teeth snapped togehter.

PREFERRED EMBODIMENT OF THE INVENTION

In FIG. 1 the reference numeral 10 indicates a spool which has circular flanges 12 and 14. When the two spool parts of the present invention to be described are secured together the reel of FIG. 1 will be provided.

In FIG. 2 there is shown one reel part which has a circular flange 16 integrally molded with an upstanding cylindrical member which is generally indicated by the numeral 18. This comprises a semi-cylindrical portion which is substantially continuous and indicated at 20, and this is integral with another semi-cylindrical portion generally indicated at 22. The latter has a lesser radius than the cylindrical half portion 20, being inset from the edges 24 thereof by an inwardly directed member portion 26, see FIG. 3. It is to be noted that both halves of the cylinder 18 are the same member, i.e. they are integral.

Whereas the half cylinder member 20 is substantially continuous and solid, the member 22 is provided with a pair of longitudinal slots 30,30 defining between them a free-ended tongue 32, this tongue having teeth thereon with slanting sides 34 and straight flat sides 36, FIG. 6. The entire tongue 32 is slightly flexible for the purpose to become apparent hereinafter, and is preferably slightly shorter than the length of half-portion 20.

The solid semi-cylindrical portion 20 of the cylinder has centrally thereof adjacent the flange 16 a series of teeth 40 which are complementary to those at 34 but being on the substantially inflexible cylindrical half member 20, teeth 40 cannot spring, while the teeth 34 are on the flexible tongue which can be moved inwardly toward the center of the cylindrical structure, starting at the free-end.

Refer now to FIG. 5, in order to form a single reel, the two spool members 18,18, are telescoped together. These two members are exactly alike and have been given the same numerals but it is pointed out that when they are moved together it is necessary for the part 20 of the larger radius to assume a position outside the part 22 of smaller radius. In other words tongues 32 are placed diametrically opposite each other and of course the same is true of the teeth 40.

When the teeth 34 snap over the teeth 40 as they can do to the resiliency of the tongue 32, the teeth become enterengaged at their flat sides sliding up over the tapered sides thereof to become permanently interconnected, with each spool part of larger radius covering each part of smaller radius, thereby forming a complete spool which is stronger than the plain extruded cylindrical spool of the prior art.

I claim:

1. A reel comprising two like parts, each part comprising a flange and a partial spool thereon, each partial spool comprising a semi-cylindrical portion of a predetermined radius, and another semi-cylindrical portion of lesser radius, a springy longitudinal tongue forming a part of one of the semi-cylindrical portions, interengaging means on the tongue on the outside aspect thereof, and complementary interengaging means on the other of said semi-cylindrical portions at the inside aspect thereof, said interengaging means forming a snap-over connection upon longitudinal motion inwardly together of said spool portions to a point where the free ends of each semi-cylindrical portion approaches the inside aspect of the flange on the other of said semicylindrical portions.

2. The reel of claim 1 wherein the tongue forms a part of the semi-cylindrical portion of lesser radius.

3. The reel of claim 1 wherein said interengaging means comprises serrations.

4. The reel of claim 3 wherein said serrations comprise teeth having slanting surfaces facing towards the other partial spool.

5. The reel of claim 4 wherein the teeth have substantially co-planar flat faces bearing on corresponding flat faces of the teeth on the other partial spool.

6. The reel of claim 1 including longitudinal slots along two sides of the tongue defining the same.

7. The reel of claim 1 including longitudinal slots along the sides of the tongue defining the same, said slots extending from one end of the semi-cylinder of lesser diameter to a point closer to the flange integral therewith.

* * * * *